United States Patent [19]

Nolan

[11] Patent Number: 4,541,634

[45] Date of Patent: Sep. 17, 1985

[54] BOARD GAME

[76] Inventor: Richard H. Nolan, 7 Lawrence Rd., Weston, Mass. 02193

[21] Appl. No.: 697,890

[22] Filed: Feb. 4, 1985

[51] Int. Cl.[4] ..... A63F 3/00

[52] U.S. Cl. ..... 273/271; 273/288; 283/49

[58] Field of Search ..... 273/148 R, 236, 269, 273/271, 273, 282 R, 288; 283/49, 50

[56] References Cited

U.S. PATENT DOCUMENTS

| | | | |
|---|---|---|---|
| 806,662 | 12/1905 | Hammond | 283/49 |
| 1,373,016 | 3/1921 | Mueller | 283/50 |
| 1,912,984 | 6/1933 | Jones | 273/148 R UX |

OTHER PUBLICATIONS

Game of "Maltese" TM box top and rules, copyright 1977.

"Games with Playing Cards", by Joseph Leeming, published by Franklin-Watts, Inc., N.Y., copyright 1949, pp. 53–57 and 76–80.

*Primary Examiner*—Anton O. Oechsle

*Attorney, Agent, or Firm*—Henry C. Nields

[57] ABSTRACT

Each player has a board having a number (N) of rows each of which comprises a number of sockets. The number of sockets in the first row is one, the number of sockets in the second row is two, the number of sockets in the third row is three, and so on up to the Nth row, which N sockets. The game is played with a multiplicity of small pieces which fit into the sockets and which, when laid on a table with the proper orientation, reveal one of a number of N of first (or "visible") characteristics, such as color. Each small piece also has one of a number N of second (or "concealable") characteristics, such as color, which may be revealed or concealed, as desired. The small piece is constructed in such a manner that the first characteristic is always viewable whenever the second characteristic is revealed. The game apparatus also includes a die to determine the sequence of play, as well as a number N of small pieces which are wild. The game proceeds in major increments which I call "jousts". A joust ends every time a player fills each row of his board with small pieces having the same second characteristic, the second characteristic for each row differing from that of all other rows, and said player may be said to have won said joust. In a preferred embodiment of the invention, disclosed and claimed herein, the game apparatus also includes a tabulator which records the total number of filled sockets for each player at the end of each joust and accumulates said totals from joust to joust until a predetermined total is reached by at least one player. In recording said total numbers, a predetermined premium is added to the total of the player who won the joust.

7 Claims, 10 Drawing Figures

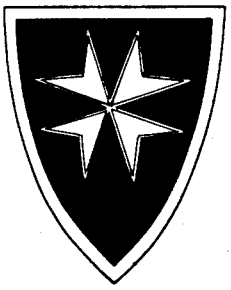

FIG. 7

OFFICIAL TOURNAMENT SCORECARD

| SINGLES | | | | DOUBLES | | | | TEAM "A" vs. TEAM "B" Jousters 1&3 Jousters 2&4 |
|---|---|---|---|---|---|---|---|---|
| JOUSTERS | | | | JOUSTERS | | | | Total Scores of Team "A" and Team "B" |
| 1 | 2 | 3 | 4 | 1 | 2 | 3 | 4 | |
| | | | | | | | | |

In singles, the leading jouster with a cumulative score of 50 or more points at the end of any joust, is the Winner.

In doubles, the leading team with a cumulative score of 100 or more points at the end of any joust, is the Winner.

SCORING OF POINTS

The winner of each joust scores 15 points, 1 point for each of the 15 small shields on the winner's playing field when the joust ended.

Additionally, the Winner recieves a Bonus of 10 points for Winning the joust Other points may also be scored as set forth under MALTESE®CROSS IMPRINTS in the RULES FOR PLAYING AND SCORING.

Scoring Example: If the Winner of the joust has 2 Maltese crosses on his playing field when the joust is won, he scores 40 points, by being able to double the number of small shields on his playing field when the joust was won; plus the winner's bonus of 10 points.

FIG. 6

BOARD GAME

BACKGROUND OF THE INVENTION

Board games have been known since antiquity. Most of such board games involve a common board shared by all the players. Among these, so-called "track" games such as parchisi and backgammon involve progression of pieces around the board. Checkers and chess involve competitive movement about the board and capture of other player's pieces. Tic-tac-toe involves the placement of pieces on a common board, as does the Japanese game of "go". Some games, such as that described in U.S. Pat. No. 3,565,436, do involve use of separate boards by each player.

SUMMARY OF THE INVENTION

The invention comprehends a board game in which each player has his own separate board, and in which the play is effected by drawing pieces from a common supply thereof and placing the pieces in sockets in the boards. Each piece has two characteristics, only one of which is visible while in the common supply, and each piece may be placed in the socket in such a manner as either to reveal or conceal the second characteristic. The sockets are arranged in rows having differing numbers of sockets. The game proceeds in major increments which I call "jousts". A joust ends every time a player fills each row of his board with pieces having the same concealable characteristic as the other pieces in that row, but differing from the concealable characteristic of the pieces in all the other rows. The sequence of play may be determined by a die, which requires each player to draw from the common supply a piece having a specified visible characteristic. The visible characteristic also plays a role in those aspects of the game which involve so-called "matching" rows. As each player completes an unmatched or matched row, the rules of the game enable him to force other players to return socketed pieces back to the common supply in various ways. Thus the game involves not only the completion of one's own board, but also the decimation of one's opponent's boards. In a preferred embodiment of the invention, disclosed and claimed herein, winning a single joust is insufficient to win a multi-joust game, and it may be possible for a player to win a game without having won a joust.

A major object of my invention is to provide opportunities for competitive play under circumstances involving not merely the movement of playing pieces on a board at random pursuant to the throw of a die, but rather under circumstances of play requiring intellectual effort and competitive thinking in response to the play of opponents. The board game of my invention is useful particularly in an educational environment such as high schools, where tournament play has been promoted by the faculty as an important stimulus to the intellectual development of the students. Experimentation of my board game in such tournament environment has demonstrated the superiority of multi-joust play in serving such educational purposes.

DESCRIPTION OF THE DRAWING

The principles of the invention may best be understood from the following detailed description thereof, having reference to the accompanying drawing, in which:

FIG. 6 is a top view of a representative tabulator for use with the preferred embodiment of the invention which is claimed herein; and FIG. 7 is a top view of a representative marked small shield suitable for use with the invention.

DESCRIPTION OF A PREFERRED EMBODIMENT

Figure 1:
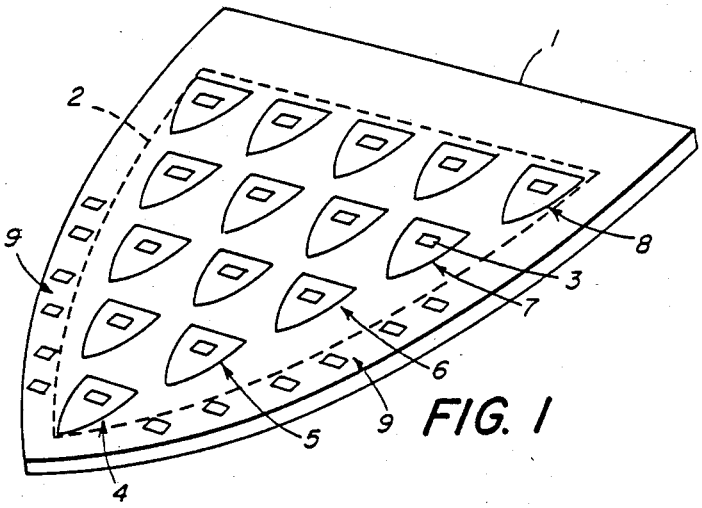
FIG. 1 is a perspective view of a representative game board suitable for use with the invention.
Figure 2A:
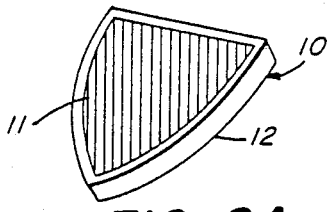
FIG. 2A is a perspective view of a representative small shield suitable for use with the invention.
Figure 2B:
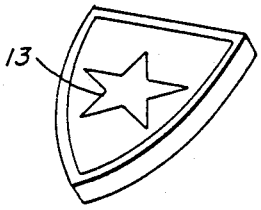
FIG. 2B is a perspective view of a representative "wild star" suitable for use with the invention.
Figure 3A:
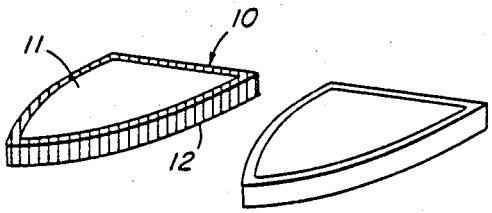
FIGS. 3A, 3B and 3C are perspective views of representative small shields suitable for use with the invention and showing the positioning of the small shields in a row having two slots, FIG. 3A showing a finished unmatched row of white inserts, FIG. 3B showing a finished matched row of white inserts, and FIG. 3C showing an unfinished row of white inserts.
Figure 3B:
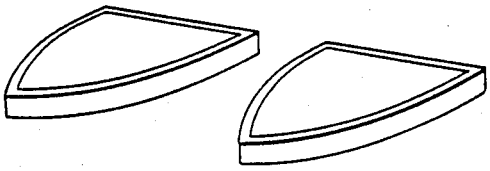
Figure 3C:
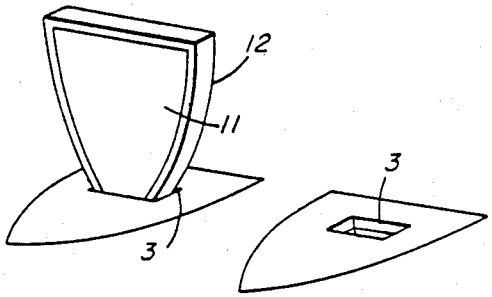
Figure 4:
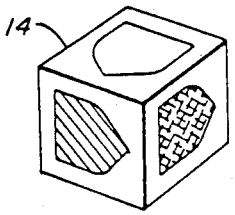
FIG. 4 is a perspective view of a die suitable for use with the invention.
Figure 5:
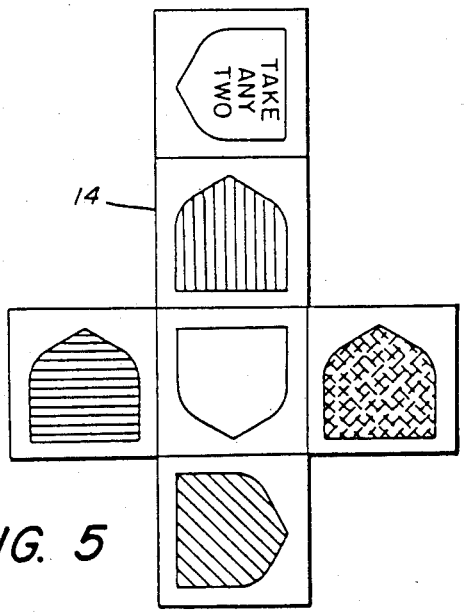
FIG. 5 is a developed view of the surfaces of the die of FIG. 4.

A typical game apparatus may have four large shields 1, each of which has a "playing field" 2 comprising five rows of slots 3. The number of slots in each row varies from one to five, so that the first row 4 has one slot, the second row 5 two slots, the third row 6 three slots, the fourth row 7 four slots, and the fifth row 8 five slots. In addition, each large shield has a number of extra slots 9 which are used for storage.

In addition, such a typical game apparatus may have eighty-five small shields 10 which are all made with one side recessed. This recessed side 11 is called the "insert"; the other side 12 is called the "cover". Each insert and each cover is of one of five colors: for example, white, orange, blue, red or green. Nearly one half of all small shields have matching inserts wherein the color of the insert is the same as that of the cover; thus there are eight matched shields of each color. Five small shields, one of each cover color, have a star 13 for an insert; these are called "wild stars". There are two each of the possible color combinations of unmatched shields, giving a total of forty unmatched shields.

At the start of the game, each player takes one of the large shields and places it flat on the table in front of him with the slots uppermost. All of the eighty-five small shields are placed in the center of the table with their inserts face down and hence concealed from view. The area in which these small shields are thus collected is called the "armory". First, every player picks up one small shield of each of the five colors showing from the armory, being careful not to let any opponent see the insert colors thereof. The five small shields thus drawn may conveniently be placed in the storage slots of that player's large shield, with the inserts facing him and thus concealed from his oppenents. While in this storage area, the small shields may be referred to as that player's "arms".

After every player has picked up his initial five shields, the play begins by taking turns. In a two-handed game, turns simply alternate. In a several-handed game, the turn may move clockwise from player to player. Each player in his turn rolls the die 14 and selects from the "armory" a shield the visible color of which is the same as the color which is indicated on the top of the die, and the shield so selected is placed in that player's storage area as an addition to his "arms".

In the second phase of his turn, the player plays one or more of his "arms" on his "playing field" by transferring one or more small shields from his storage area to slots in the five rows, while maintaining concealment of the inserts. The only restriction on such transfer is that no two rows may have small shields therein having the same insert color at the same time. The ultimate objective is to fill all five rows, each with small shields having the same insert color. If, by virtue of such transfer, any row is filled up, or finished, all small shields in the finished row should then be placed insert side up. In so doing, each such small shield remains over the slot in which it had previously been inserted, and I use the term "socket" herein to identify the position which is identified on the large shield by such a slot, and such a "socket" may be said to contain a playing piece whether a small shield is inserted therein or, subsequent to such insertion, lies flat over it. The player making such transfer gains two advantages. First, he earns an extra throw of the die. And, second, all other players must return to the armory all small shields in any unfinished row having the same insert color as that of the small shields in the row just finished by the player making such transfer.

If, by virtue of such transfer, the player making such transfer creates a row which is filled up, or finished, with small shields all having the same color as well as the same insert color, that row is called a "matching row", and the act which creates it is called "matching" a row. A row may be matched at the same time that it is finished, or a finished but unmatched row may be matched by replacing all unmatching pieces in the row with matching pieces during the second phase of a player's turn. The player matching a row gains the following advantage: all other players must return to the armory all small shields in the row of their respective playing fields having the same row number as that of the row which has just been matched, unless that row is also a matching row. However, matching a row does not entitle a player to an extra turn unless the row is simultaneously finished. Also, the matching of rows is not necessary to win a joust: only the insert colors are used to determine when all of the five rows have been finished and the joust won.

As described hereinabove, during the second phase of his turn, a player may play one or more of his arms on his playing field. He need not do so, and if he does not, it is said that he "passes". The replacement of an unmatched shield with a matched one does not constitute playing a piece in the sense of the "passing" rule. Of course, if a player cannot play a piece on the playing field, he must pass; but he may pass even if he need not. In any event, the result of any "pass" is that the passing player's opponents may, in turn, guess one of the insert colors. If the color guessed is the same as any insert in the passing player's arms, it is a correct guess, and the correctly-guessing player receives from the passing player all small shields in the passing player's arms which have the inserts of the same color as the guessed color. Moreover, immediately after a successful guess, the correctly-guessing player has the opportunity to win that joust immediately by completing all rows in his playing field. If the guessing player guesses a color which is not among the insert colors of the passing player's arms, then it is an incorrect guess, and the incorrectly-guessing player is penalized by losing his next turn of play. The opportunity to guess after each pass moves around the table to the passing player or until a correct guess is made. No player is required to guess; a player may prefer not to guess and simply to await his or her next usual turn of play.

The five "wild stars" have special properties during play. A wild star becomes any color insert that the possessor thereof wishes it to be. If it is alone in an unfinished row, it has not yet taken on any color and thus cannot be knocked off of the board at that stage. However, as soon as a small shield having a colored insert is placed in the same row with the wild star, it temporarily acquires the same color as its neighbor, and then it may be knocked off of the playing field. If a wild star is used in the row which has only one socket, the insert thereof must be declared to be a certain color.

A wild star may be moved from one row to another by so doing and then refilling its vacated slot with a small shield having an insert of the same color as that which the wild star had been representing, all in the same turn. The wild star thus moved then thereby acquires the new color of the row to which it is moved.

The "wildness" of the wild star applies only to the insert color; each wild star has a fixed cover color.

As stated hereinabove, the ultimate objective is to fill all five rows, each with small shields having the same insert color. The first player to accomplish this may be said to have won a joust. After completion of a joust in this manner, play may begin all over again, and continue until the second joust is won, and so on. If more than one joust is played, at least two embodiments of the game are possible. In one embodiment of the game, the players simply keep track of the number of jousts won. In a preferred embodiment of the game (which is described in detail hereinafter and which forms the subject matter of the invention herein claimed), after each joust, the winning player records a score of a number of points (such as 20) which is slightly greater than the number of small shields filling his playing field, while each of his opponents records a score of a number of points equal to the number of small shields which remain on his playing field at the time the joust is won. In this preferred embodiment of the game, victory is achieved by the player who first exceeds a certain number of points, such as 25 or 50. In this preferred embodiment of the game, it is also possible to organize the players in pairs, in which case each pair forms a team having a score equal to the sum of the scores of the individual players in the pair. In this event, victory is achieved by the team which first exceeds a certain number of points, such as 50 or 100.

Since the preferred embodiment of the game also involves the playing of individual jousts, certain techniques of playing such jousts will now be described.

THE PREPARATION

You are probably sitting across a table from your opponent, each of you having your large shield directly in front of you. The colors of these large shields have no meaning; they are only decorative. The important colors are on the 85 small shields which are all made with one side recessed. This recessed side is called the "insert". Each of the 85 small shields is to be turned insert side down in the center of the table before beginning. The center of the table where the small shields are kept is called "the armory". First, every player picks up one small shield of each of the five colors showing from the armory. Don't let your opponent see the insert colors of the small shields you choose.

Now look at your large shield. It is slotted, and most of the slots form rows numbered 1 to 5. These rows are called the "playing field". Each slot on the playing field has a gold silhouette painted around it. The remaining slots are merely storage area surrounding your playing field. Place the five shields you just drew in these storage slots so that only you can see the insert colors. While your small shields are in this storage area, they are called your "arms". Your are now ready to make your first turn at play.

THE BEGINNING OF THE TURN

In a two-handed game, turns simply alternate. In three-or-four-handed games, the turn moves clockwise from player to player. The initial turn may be selected in any suitable manner is by successive rolls of the die and the first player to roll a certain color (such as green) being authorized to start play by again rolling the die. Assume that it is now your turn. A turn begins by rolling the die and selecting the color shield indicated on the top of the die from the small shields remaining in the center of the table i.e., "the armory". If at any time all shields having a cover of the color shown on the top of the die are gone from the armory, you simply roll the die again. Put this newly selected small shield into storage as you did the original five you drew during your preparation. Look at the insert colors of all of these small shields you have collected and realize that to win the joust you must fill Row #1, Row #2, Row #3, Row #4 and Row #5, each with a different insert color. Only five insert colors are available and they are white, orange, blue, red and green. Any color insert may be used in any number row but no two of your rows are allowed to use the same insert color at the same time. After looking carefully at the combination of insert colors which make up your "arms", make your first move. Play one or more of your pieces onto the playing field. If what you play happens to finish any of the five rows, you have earned an extra throw of the die. If, on the other hand, you play a small shield in a row and do not fill up that row, leave the shield standing in the slot to prevent your opponent from figuring out what color inserts you are using to fill that row. Each time you finish any row, you not only get to throw the die again, but you might have caused injury to your opponent. You may have knocked off any small shields which he may have standing in an unfinished row of his playing field.

EXAMPLE A

Assume that you fill your #1 row with a small blue shield having a red insert. You must immediately lay that shield down flat in the row with the red insert color showing to your opponent, and leave it showing thereafter. As you show him the red insert, you announce to him that if he has any red inserts standing in any unfilled (i.e., unfinished) row of his playing field, they are all lost back to the center of the table, "the armory". He then must place his knocked off pieces insert side down in the armory. However, he does not lose any red inserts remaining in his storage area, his "arms".

Assume now that your announcement is done, and you find that you have damaged your opponent by causing him to lose some of his shields. He will have to begin again at building a row with the insert color which you caused him to lose. If he did not lose anything, you may still have profitted by learning what he has not played, which is often as valuable as knowing what he has played. Remember, the method of attacking your opponent given in Example A is used only against your opponent's rows which have been started but are in an unfinished condition, that is, unfilled.

As you may imagine, there is an even more devastating method available for attacking your opponent. This second method enables you to eliminate certain rows even though your opponent may have already finished the row.

EXAMPLE B

As in the earlier example, assume that you are completing the #1 row on this turn and that you are using the red insert to do it. The only difference is that this red insert is set inside of a matching red cover (i.e., the outside of the shield). You have done two things at once. First, you have finished a row and thus become entitled to make the announcement given in Example A. Secondly, you can now make an additional announcement because you have not only finished the row, but you have matched a row. A matching row occurs only when all of the shields in a finished row have the same color inserts and covers. No row can be called matched or unmatched until it is filled. In this example of the #1 row, the insert used to finish the row is red and the outer part is red, and therefore the row is a matching row. Any time you match a row, you must announce it in a certain manner. In this example, you would say: "All unmatched #1 rows are back to the armory. If your opponent happens to have his #1 row finished with, say, a green insert inside a white cover, he would be forced to lose this unmatched #1 row. He would have to return it to the armory, insert side down once again.

It is most important to understand the difference between the maneuver described in Example A, unfinished rows, and that described in Example B, unmatched rows. Your understanding here is fundamental to your enjoyment of the game. Unfinished rows are only knocked off by the color while unmatched rows are only knocked off by row number! Think about this. If you finish any row with blue inserts, you say, "all unfinished blue rows back to the armory"; when you match a row, however, you say: "All unmatched rows of the same row number back to the armory". So a matched #4 row can only eliminate unmatched #4 rows. Likewise, a matched #2 row eliminates any unmatched #2 rows. It does not matter what color inserts are in either the matched row or the unmatched row. All that matters, is that a numbered row is being matched and the same numbered row is finished but unmatched on an opponent's playing field.

You would be attacking your opponent in major fashion if you were to, as in Example B, complete a row and match it at the same time. Such a move affects both unfinished rows of the same color and unmatched rows of the same number. However, you do not have to match a row at the time you finish it. You can, if you would like, convert an unmatching row into a matching one by replacing all unmatching pieces in the row with any matching pieces you have available. This may be done only during your turn of play. When you do so, you make the necessary announcement.

The effect of finishing or matching a row is instant trouble for your opponent, but the injury of those moves ends as your turn ends. So, although your opponent may have lost pieces, he can rebuild rows from which his pieces were lost without being concerned about you matching the same row a second time. Having taken your best shot your damage is done.

EXAMPLE C

You match the #2 row early in the game with white inserts and white covers. Your opponent on his next move fills his #2 row with orange inserts, but his covers for the row are not both orange as are both inserts. His is an unmatched #2 row. His row can not be knocked off now by your matched #2 row because when you matched your row, he did not have a finished unmatched #2 row. The power of the match applies only to the moment of the match.

In the same sense, the finishing of a row has damaging power only at the moment it is finished.

Lastly, the matching of rows is not necessary to win a joust. Remember, only the insert colors are used to determine when all of the five rows have been finished and the joust won.

ENDING THE TURN

Your recall that your turn began by throwing the die. The end of your turn occurs when you have stopped playing small shields on your playing field and have not earned any additional throws of the die. If your turn ends, simply pass the die to the next player in order for him to begin his turn. However, if your turn ends without your playing the additional piece required by each roll of the die, you must pass.

PASSING

Passing is a somewhat frequent occurence in two-handed games of Maltese. It will almost surely take place in a three-or-four-handed game. Some players build much of their strategy around the "Pass", so I think it best to discuss it in some depth.

Passing is forced or voluntary. Let us look first at a forced pass.

EXAMPLE D

You roll the die during your turn and, as always, you choose another small shield from the armory as the die instructs. You look at the insert color of the shield just drawn and, unfortunately, realize that it, together with the other shields in your arms, are not playable.

What makes them not playable is the simple fact that you have no place left on your playing field to play them. Assume you have in your arms only green and orange inserts and you have already finished a green row and an orange row. You cannot have two rows of the same color and you cannot move what you have already played. Your arms have become a sort of uselesss baggage. However, inserts that are useless to you may well be inserts sought by your opponent. In this situation, the rules force you to declare a pass.

What happens each time you pass can be a boon to your opponent! He may guess one color of the five insert colors. He may only guess one color each time you pass. If he guesses a color which is same color as any insert in your arms, it is a correct guess. If he guesses correctly, he must be given every insert of the guessed color which you have in your arms. You turn over to him no pieces from your playing field, only inserts of the color guessed which are in your arms. If he guesses an insert color which is not among your arms, he has guessed incorrectly. Any player who guesses correctly is penalized by losing his next turn of play.

The second kind of pass is voluntary. It works the same as the forced pass. The only difference is that the player passing is merely pretending that he is unable to play when he really can. This tactic is a bit advanced and you will learn its worth as a method of causing your opponent to lose his next turn. The danger of the voluntary pass is that an unskilled opponent may unwittingly make a correct guess or a skilled player may sense the bluff and guess correctly.

I must mention three fine points in this area of passing. First, if in your turn, you replace an unmatched shield with a matched one, you may not consider this to be the playing of an additional piece. Failure to add an additional piece to your playing field after each roll of the die will force you to pass.

Secondly, during a pass the opportunity to guess moves around the table to the original guesser or until a correct guess is made. If an opponent chooses not to guess, then the opportunity to guess simply moves from him to the next player. If the opportunity to guess moves around to all of your opponents and none of them has made a correct guess, then the next turn should begin. But remember, those who have guessed incorrectly have lost a turn.

Thirdly, in order to fully understand whether or not you are in a forced pass situation, you should know the special treatment of the Wild Stars.

WILD STARS

One thing is for sure, wild stars are a tremendous asset. There are only five of them, one for each of the five colors of inserts. They are almost totally versatile pieces. A wild star becomes any color insert that you wish it to be. If it is sitting in an unfinished row by itself, it has not yet taken on any color and thus cannot be knocked off of the board at that stage. It does, however, temporarily become the same color as any insert which is played in the same row with it. Then it may be knocked off of the playing field.

You can move a wild star from one row to another by simply refilling its vacated slot with the same color insert which the wild star had been representing, in the same turn. The star then becomes the new color an any row it is moved into. Notice that this combination of play adds another piece to the board and so is not a "passing" situation. If it stands alone, the star has no color. There is one exception. If it is used to complete the #1 row, it must be declared to be a color, and it can only be moved from that row with proper replacement by a piece having an insert of the declared color.

The wild stars may be knocked back into the armory whenever they are taking on the color of the row in which they are played.

The only limitation on the wildness of the stars is that they are bound by the same matching rules as are all of the other small shields. A wild star can only be declared to be a matching piece when its cover is the same color as all of the inserts used to fill a row. If a wild star becomes part of a matching row, it can only be moved by replacing it with a matching shield.

ODDS

The fact that nearly one half of all small shields have matching inserts is most important in your game strategy. This fact enables you to (1) more perfectly analyze your opponent's plays, (2) effectively choose small shields when your throw of the die reads "take any two", and (3) improve your ability to guess correctly during an opponent's "pass".

The foregoing techniques of playing jousts are applicable if only one joust is played. If more than one joust is played, then the foregoing techniques are fully applicable to the first embodiment of multi-joust play, in which the players simply keep track of the number of jousts won. However, caution is advisable in applying the foregoing techniques to the second embodiment of multi-joust play, because the principles of play in the second embodiment differ radically from those of the first embodiment and from those of single-joust play. For example, in certain instances in the second embodiment a player can win a match without ever having won a joust.

Said second embodiment of multi-joust play, which is claimed herein, will now be described.

In said second embodiment it is not sufficient for a player to win a joust in order to win a match. In said second embodiment, which I call "medal play", each match consists of a plurality of jousts, and the winner of a match is the player who, at the end of any joust, has accumulated a number of points which is determined in advance and which I call "goal score". As before, a joust ends when a player has filled all the sockets on his game board. However, at that time each player acquires a number of points equal to the number of sockets which are filled on his game board at the time the joust ends. The player who won the joust receives a premium above the total filled sockets on his game board. However, this premium is a relatively low number. The premium should be less than the total number of sockets on each game board, and preferably is of the order of two thirds the total number of sockets on each game board. The number is so chosen that it is possible for a player to win a match even if he is not the player who has won the most jousts. In a preferred form of this embodiment, at least three players are required and under these circumstances the play is so arranged that it is possible for a player to win a match without even having won a joust. For example, if two different players each win a joust but have no filled sockets at the end of the joust won by the other player, and if the third player filled all but one of his sockets at the end of each joust, the third player will win if the goal score and the premium are sufficiently low.

In order to play the game in this manner it is necessary to have, in addition to the above-mentioned components, suitable means for accumulating the sequential scores of each joust for each player. Such means may be a suitable scoring tabulator and, in its simplest form, may comprise a score card of the type shown in FIG. 6. The tabulator must include means for recording the number of filled sockets on each game board at the end of a joust, and means for adding said number to the accumulated number of filled sockets for that game board resulting from all previous jousts in the match. The tabulator must also include means for identifying the premium and, at the end of each joust, adding it to the accumulated number of filled sockets for the game board of the winner of that joust. The tabulator must also include means for identifying the goal score and means for indicating when the total accumulated number of filled sockets for any of said game boards equals or exceeds said goal score and for indicating which game board has such a total accumulated number.

It is necessary that the goal score be set sufficiently low so as to preserve interest and enthusiasm during the playing of a match. Preferably this goal score is about two or three times the total number of sockets on each of the game boards.

Said second embodiment of multi-joust play is capable of a score-multiplying modification which is not possible with said first embodiment of multi-joust play nor with single-joust play. In said modification, special markings are added to a few of the unmatched pieces. Except as hereinafter set forth, the presence of such special markings has no effect on the use of such marked unmatched pieces. For example, a limited number (such as 5) of the unmatched pieces (e.g. one for each first characteristic) may have a special mark on their inner face having the property that such a piece can never be substituted for a matched piece, and the further property that the presence of such a marked piece on the game board of a joust-losing player is required in order that a joust-losing player may acquire a number of points equal to the number of sockets which are filled on his game board at the time the joust ends. The presence of more than one such marked piece on the game board of any player multiplies the point score of the player on whose game board it remains at the end of a joust. Such special mark is preferably a Maltese Cross and the marked pieces are preferably as follows: red cover with white insert, white cover with orange insert, orange cover with red insert, blue cover with green insert, green cover with blue insert.

It has been pointed out hereinabove that, in a player's turn, he may convert an unmatched row into a matched row. However, once a matched row is completed, it cannot be made into an unmatched row. If desired, the premium for the joust-winner may be omitted.

A Maltese Cross does not change the color of the insert, nor does it affect the winner's bonus. If there are shields displaying a Maltese Cross on the playing field at the time the joust ends, these shields add to the scoring in the following manner: each losing jouster who, when the joust ended, had one shield in the playing area showing a Maltese Cross, also receives one point for every shield then on his or her playing field. Each jouster, whether winner or loser of the joust, who, when the joust ended, had more than one Maltese Cross shield, similarly in play, scores a multiple of the number of shields on his or her playing field when the joust ended, said multiple being equal to the number of Maltese Cross shields thus remaining in play.

In the preferred embodiment, a typical number of Maltese Cross imprints is a total of 5 Maltese Cross imprints per game. All 5 are imprinted only on unmatched shields and each of these shields has a cover of a different one of the 5 basic colors. Similarly, the insert of each of these unmatched shields is of a different one of the 5 basic colors. The color combinations of these unmatched, Maltese bearing shields are constant in all games. Knowledge of this fact is often a necessary mental aid in selecting small shields when a rolled die shows "Take any two".

The fact that no matching row can contain a Maltese Cross and no matching row can be corrected into an unmatched row to accept a Maltese Cross, causes further consideration before completing a matched row. This is due to the possibility of subsequently obtaining a Maltese Cross of that color insert, which couldn't be played, and the player concerned might be compelled to turn it over to an opponent after a "Pass", followed by an opponent's right color guess, etc.

There are various possible combinations of first and second characteristics to which a Maltese Cross can be applied. Assuming that there are five basic colors and that these are red, blue, green, white and orange, then there are four alternatives for the piece with a red cover to which a Maltese Cross is applied: namely, its insert may be blue, green, white, or orange. For each "red" alternative, there remain three alternatives for the piece with a blue cover to which a Maltese Cross is applied: namely, its insert may be any color except blue or the color of the insert on the red-covered piece. The total number of available combinations may be calculated mathematically. The important point is that the same pattern of combinations is maintained throughout any tournament, so that any player who learns and remembers the pattern has an advantage over a player who does not.

Having thus described the principles of the invention, together with an illustrative embodiment thereof, it is to be understood that, although specific terms are employed, they are used in a generic and descriptive sense, and not for purposes of limitation, the scope of the invention being set forth in the following claims.

I claim:

1. A game method associated with a plurality of game boards each having (a) non-ordered storage sockets for storage and (b) ordered sockets, said ordered sockets being arranged in a number of rows, the number of sockets in each row permissibly varying, each game board being adapted to have an owner associated therewith, a multiplicity of playing pieces adapted to fit in said sockets, each playing piece having a first non-valued characteristic and a second non-valued characteristic, such characteristics being selected from a class having a number of members equal to said number of rows, each said playing piece being so constructed that a first side thereof exhibits both said first characteristic and said second characteristic while a second side thereof exhibits only said first characteristic, the number of playing pieces exhibiting any one first characteristic being the same as the number of playing pieces exhibiting any other first characteristic (and, among those playing pieces exhibiting the same first characteristic, about one-half having a second characteristic identical to its first characteristic, and the second characteristic of the remainder being equally distributed among the remaining characteristics), a small number of said playing pieces having on their respective first side a second characteristic which differes from said first characteristic but which bears a mark, means for repeatedly selected a first characteristic at random in such a manner that the consequence of each such selection is only (a) the addition of a playing piece having the selected first characteristic to the selector's storage and then (b) the transfer at the option of the selector, of one or more playing pieces having the same second characteristic from the selector's storage to one row of the selector's ordered sockets, and means for recording only the owner and number of all ordered sockets containing a playing piece each time all the sockets in any one game board contain a playing piece, and the rules of the game method comprising the following steps: all the playing pieces are placed in an armory so that only said second side is visible; each player takes a game board and a number of playing pieces equal to said number of rows and places said playing pieces in the storage sockets of his game board in such a manner that only said second side is visible to other players; each player in succession (1) operates said selection means to select a first characteristic and selects from the armory one selected playing piece exhibiting that characteristic, (2) adds said selected playing piece to his storage and then (3) transfers one or more playing pieces having the same second characteristic from his storage to one row of the ordered sockets in his game board in such a manner that only said second side is visible to other players and in such a manner that no two playing pieces in separate rows have the same second characteristic; the completion of any row with playing pieces having the same second characteristic by any player giving that player a certain first advantage, the completion of any row with playing pieces having the same first characteristic as well as the same second characteristic by any player giving that player a certain second advantage, and the completion of any game board with playing pieces by any player giving that player an incremental point score slightly greater than the number of filled ordered sockets on his game board and giving any other player having at least one ordered socket on his game board filled with a marked playing piece an incremental point score equal to the number of filled ordered sockets on his game board, except that any player having more than one ordered socket on his game board filled with a marked playing piece shall receive a score equal to a multiple of the number of filled ordered sockets on his game board.

2. A game method according to claim 1 wherein the number of pieces bearing said mark is equal to said number of rows.

3. A game method according to claim 2 wherein among said pieces bearing said mark no two have the same second characteristic.

4. A game method according to claim 1 wherein a player who has gained said first advantage with respect to a row may convert that row to one giving him said second advantage by substitution during said act of transfer, provided that no marked piece may ever be substituted.

5. A plurality of game boards, each having (a) non-ordered storage sockets for storage and (b) ordered sockets, said ordered sockets being arranged in a number of rows, the number of sockets in the first row being one, and the number of sockets in each succeeding row being one more than that in the preceding row, each game board being adapted to have an owner associated therewith, a multiplicity of playing pieces adapted to fit in said sockets, each playing piece having a first non-valued characteristic and a second non-valued characteristic, such characteristics being selected from a class having a number of members equal to said number of rows, each said playing piece being so constructed that a first side thereof exhibits both said first characteristic and said second characteristic while a second side thereof exhibits only said first characteristic, the number of playing pieces exhibiting any one first characteristic being the same as the number of playing pieces exhibiting any other first characteristic (and, among those playing pieces exhibiting the same first characteristic, about one-half having a second characteristic identical to its first characteristic, and the second characteristic of the remainder being equally distributed among the remaining characteristics), a small number of said playing pieces having on their respective first side a second characteristic which differs from said first characteristic but which bears a mark, means for repeatedly selecting a first characteristic at random in such a manner that the consequence of each such selection is only (a) the addition of a playing piece having the selected first characteristic to the selector's storage and then (b) the transfer at the option of the selector, of one or more playing pieces having the same second characteristic from the selector's storage to one row of the selector's ordered sockets, and a tabulator including means for recording only the owner and number of all ordered sockets containing a playing piece each time all the sockets in any one game board contain a playing piece, said owner being herein referred to as a "joust-winner" and being entitled to a premium, means for adding said number of ordered sockets to the accumulated number of filled sockets for that game board, means for identifying the joust-winner's premium and adding it to the accumulated number of filled ordered sockets for the game board owned by the joust-winner, means for identifying a goal score and means for indicating when the total accumulated number of filled ordered sockets for any of said game boards equals or exceeds said goal score and for indicating the owner of that game board, said marked playing pieces having the property that any player having more than one ordered socket on his game boad filled with a marked playing piece shall receive a score equal to a multiple of the number of filled ordered sockets on his game board.

6. Apparatus according to claim 5, wherein the number of marked playing pieces is equal to said number of rows.

7. Apparatus according to claim 6, wherein among said pieces bearing said mark no two have the same second characteristic.

* * * * *